US005490404A

United States Patent [19]

Yamada

[11] Patent Number: 5,490,404

[45] Date of Patent: Feb. 13, 1996

[54] DOOR LOCKING HANDLE ASSEMBLY

[75] Inventor: Kenichi Yamada, Tokyo, Japan

[73] Assignee: Takigen Manufacturing Co. Ltd., Tokyo, Japan

[21] Appl. No.: 265,671

[22] Filed: Jun. 24, 1994

[30] Foreign Application Priority Data

Apr. 11, 1994 [JP] Japan ..... 6-098144

[51] Int. Cl.[6] ..... E05B 13/10

[52] U.S. Cl. ..... 70/210; 70/224; 70/215; 70/DIG. 31; 292/210

[58] Field of Search ..... 70/210, 215, 224, 70/467, 469, 489, 192–197, DIG. 31; 292/200, 207, 210, DIG. 71, 336.3

[56] References Cited

U.S. PATENT DOCUMENTS

| | | | |
|---|---|---|---|
| 1,573,063 | 2/1926 | Haseltine | 292/210 |
| 2,156,513 | 5/1939 | Roedding | 70/210 |
| 4,196,602 | 4/1980 | Akselsen | 70/196 |
| 5,440,905 | 8/1995 | Yamada | 70/224 |
| 5,452,596 | 9/1995 | Yamada | 70/208 |

*Primary Examiner*—Darnell M. Boucher
*Attorney, Agent, or Firm*—Martin Smolowitz

[57] ABSTRACT

There is provided a door locking handle assembly in which a bearing (6) is provided in a base member (3); a shaft (7) mounted in the bearing (6) is fixed to a handle (4); a lock lever (5) is fixed to the handle (4); a latch casing (18) is fixed to a front of the handle (4); a lock unit (23) is mounted in a lock-receiving portion of the handle (4); a receiving portion (32) engaged with and disengaged from a dead bolt (46) of a latch (27) in the casing (18) is formed in a front of the lever (5); and, stoppers 14 and 15 of opposite ends of the lever (5) are engaged with grooves 16 and 17, respectively; whereby a fear of overlooking an unlocked condition of the handle (4) is eliminated; and, since torque from the shaft (7) is dispersed and received through the stopper mechanism (14, 15, 16, 17), a fear of deforming the unit (23) is eliminated even if the assembly is subjected to such torque in its locked condition.

3 Claims, 4 Drawing Sheets

DOOR LOCKING HANDLE ASSEMBLY

BACKGROUND OF THE INVENTION

1. Field of the Invention

The present invention relates to a door locking handle assembly used in a plugboard box and the like for opening/closing a door of the box and for locking the door to a stationary frame of the box.

2. Description of the Prior Art

In a conventional door locking handle assembly such as one disclosed in Japanese Utility Model Laid-Open No. Sho 63-162075: a locking shaft of a handle piece is rotatably mounted in a cylindrical bearing portion of a base member which is fixedly mounted on a door; a catch plate, which is engaged with and disengaged from a retaining member of a stationary frame, is fixedly mounted on a front-end portion of the locking shaft; and, when the handle piece is swung on the cylindrical bearing portion, the catch plate is rotatably driven between its locked and unlocked position. The catch plate projects from a side edge portion of the door in its locked position, and retracts to a predetermined position behind the side edge portion of the door in its unlocked position.

In the conventional door locking handle assembly: as a means for locking the door to the stationary frame in the locked position of the door, a lock unit is provided in the locking shaft of the handle piece; and, a front-end portion of a rotor of the lock unit is interlocked with a locking rod which is engaged with and disengaged from a receiving groove of the cylindrical bearing portion when the rotor is rotatably driven.

However, in the conventional door locking handle assembly, there is a fear of deforming both the locking rod and an internal locking mechanism of the lock unit when the lock unit is illegally unlocked by persons who grip the front-end portion of the handle piece and forcibly swing the handle piece without using a proper key, because the elongated body of the handle piece acts as an arm of a lever in such illegal operation to multiply the force on the handle piece several fold and the thus multiplied force produces large bending and shearing stresses in both the locking rod and the internal locking mechanism of the lock unit.

Further, in the conventional door locking handle assembly, since it is possible for the user to normally operate the lock unit even when the handle piece is not in its normally locked position, there is a fear that the user overlooks such unlocked condition of the handle piece.

SUMMARY OF THE INVENTION

It is an object of the present invention to provide a door locking handle assembly, which may prevent a user from overlooking an unlocked condition of a handle piece of the assembly since the handle piece being in any other positions except its locked position makes it impossible to operate a lock unit of the assembly in which the lock unit is free from a fear of deformation or breakage even when the handle piece is illegally forced to swing in its locked position, because, in the assembly, torque from a locking shaft is dispersed through a stopper mechanism of a lock lever.

The above object of the present invention is accomplished by providing:

A door locking handle assembly, comprising:

a cylindrical bearing portion integrally formed with a base-end portion of a base member which is fixedly mounted on a door;

a shaft which is fixedly mounted in a base-end portion of a handle piece and rotatably mounted in the cylindrical bearing portion in an insertion manner;

a catch plate fixedly mounted in a rear-end portion of the shaft, the catch plate being engaged with and disengaged from a retaining member of a stationary frame element;

a holder fixedly mounted on a bottom wall of the base-end portion of the handle piece;

a first horizontal pin inserted in an axial hole of the holder;

a lock lever which is mounted in such a way as to pivot about on the first horizontal pin;

a rotation-urging spring mounted between a projection of a bottom wall of the handle piece and a projection of a front-end portion of the lock lever;

a latch casing having its base-end portion fixedly mounted in a front-end portion of the handle piece, the base-end portion of the latch casing being provided with an axial hole;

a second horizontal pin inserted in both the axial hole of the latch casing and a rotation-restricting oval hole of a front-end portion of the lock lever;

a hollow socket portion integrally formed with the front-end portion of the lock lever;

a pair of stopper projections which are integrally formed with a base-end portion of the lock lever and the front-end portion of the lock lever, respectively;

a pair of engaging grooves for engaging with and disengaging from the stopper projections respectively, the engaging grooves being integrally formed with the base-end portion of the handle piece and the front-end portion of the handle piece, respectively;

a lock-receiving portion integrally formed with the front-end portion of the handle piece;

a lock unit mounted and received in the lock-receiving portion;

a joint member interlocked with a rotor of the lock unit;

a receiving groove engaging with an engaging projection of the joint member;

a latch element which is interlocked with the joint member to move back and forth and received in the latch casing;

an engaging projection formed in a rear-end portion of the latch element so as to be engaged with and disengaged from a groove of the base member; and a dead bolt formed in a base-end portion of the latch element so as to be engaged with and disengaged from the receiving portion of the lock lever;

wherein: the dead bolt of the latch element is received in the receiving portion of the lock lever to hold the lock lever in its locked position; and, the pair of the stopper projections of the lock lever engage with the pair of the engaging grooves respectively to divide torque from the shaft and receive the thus divided torque so that the handle piece is locked to the base member.

DESCRIPTION OF THE PREFERRED EMBODIMENTS

Figure 1:
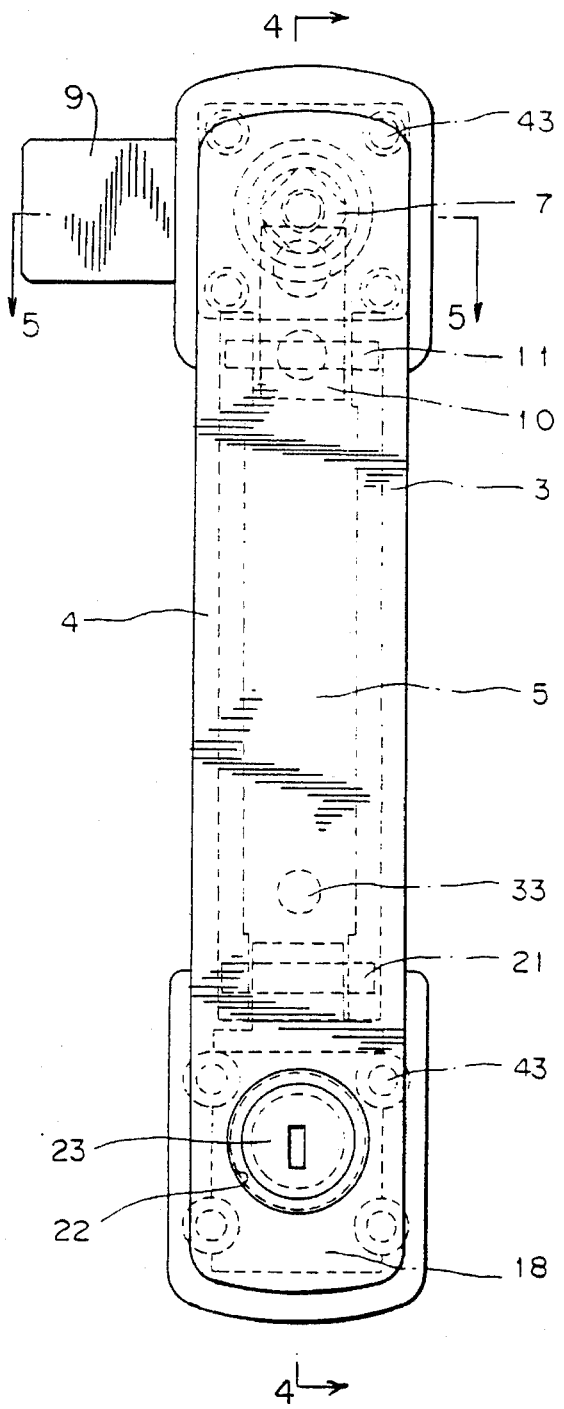
FIG. 1 is a front view of an embodiment of the door locking handle assembly of the present invention in its locked position.
Figure 2:
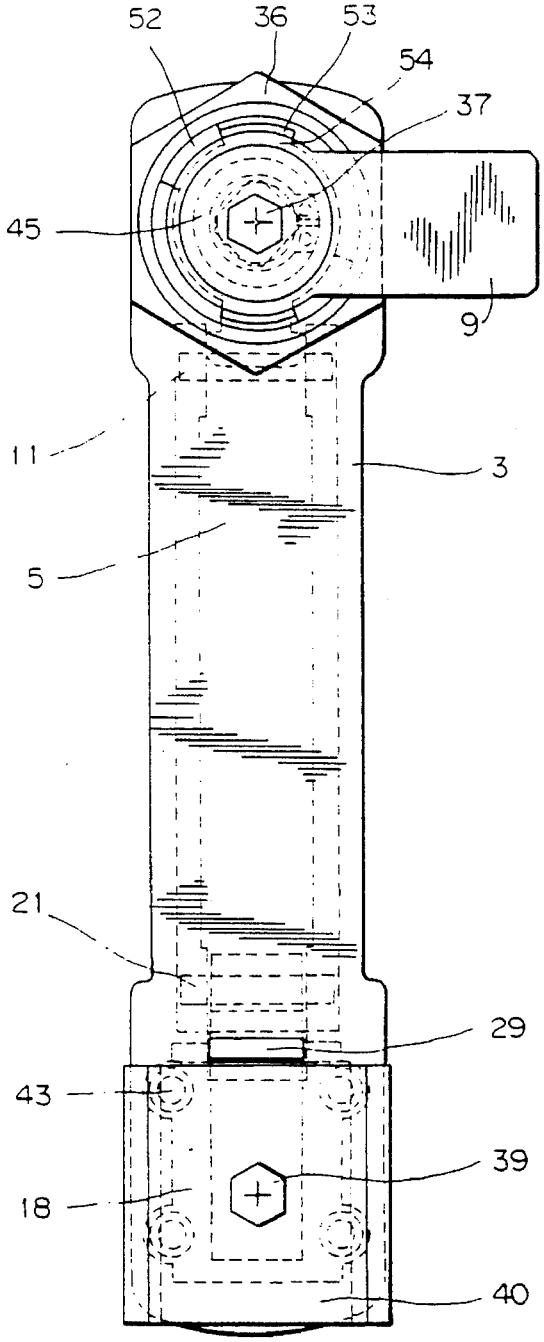
FIG. 2 is a rear view of the door locking handle assembly shown in FIG. 1.
Figure 3:
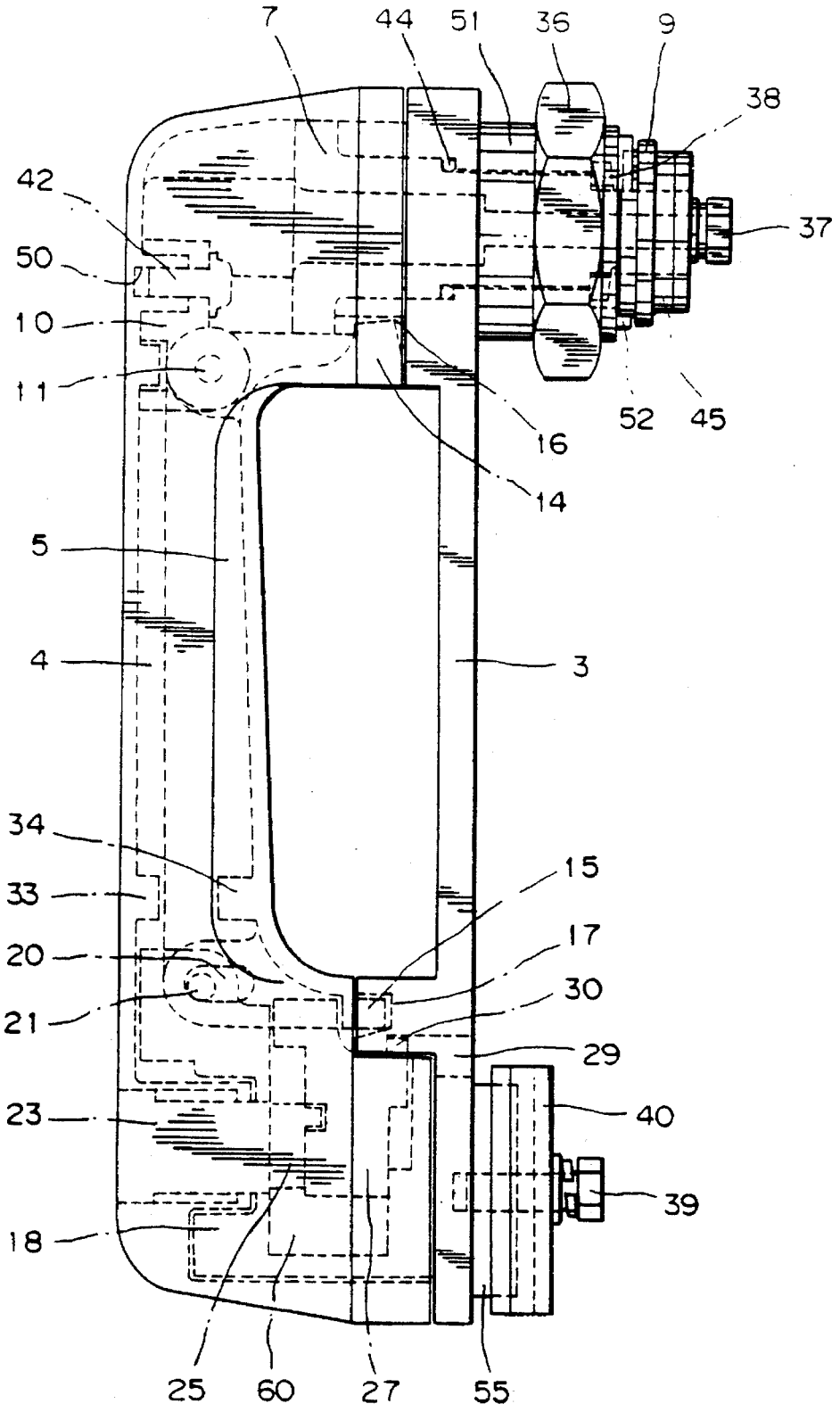
FIG. 3 is a right-side view of the door locking handle assembly shown in FIG. 1.
Figure 4:
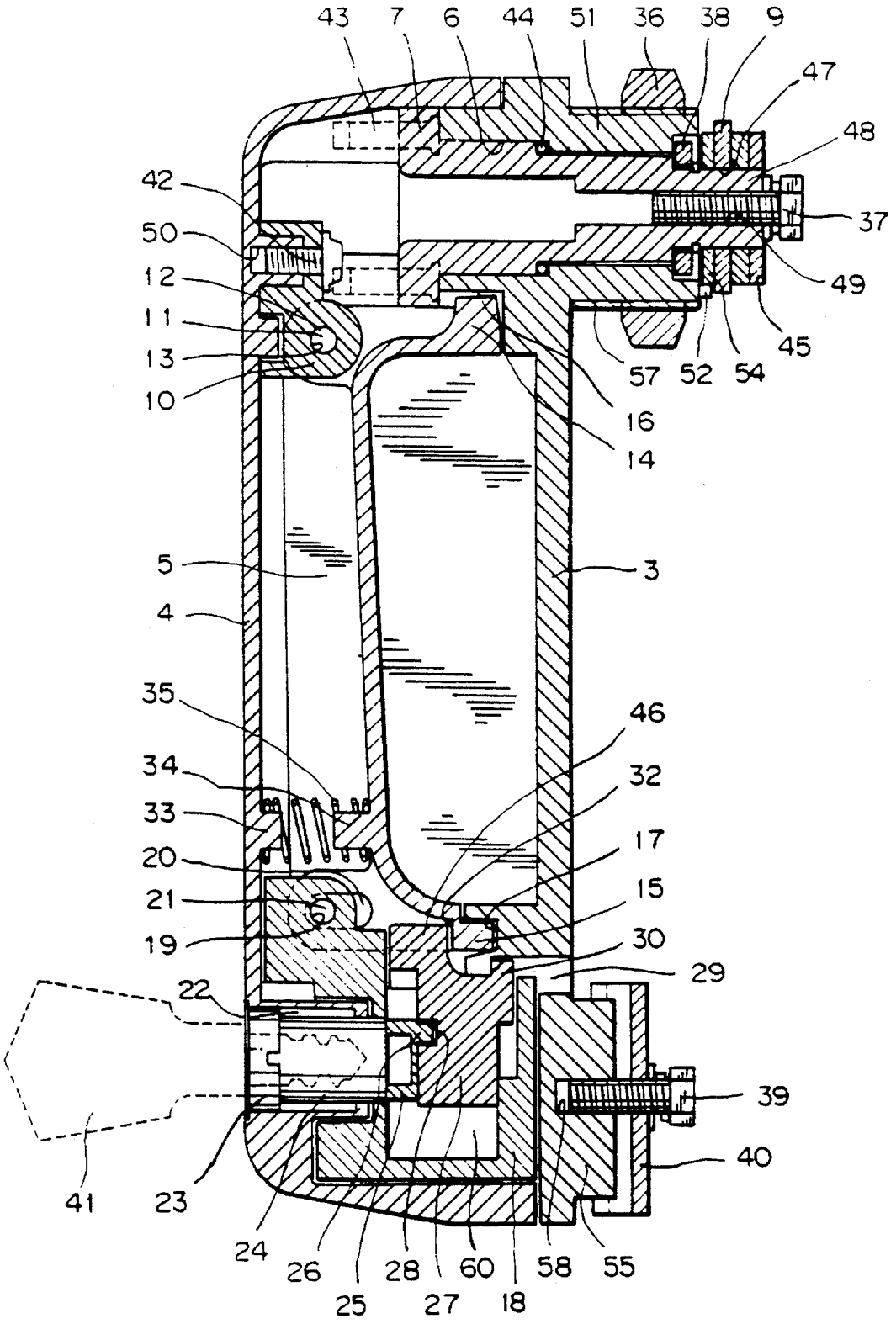
FIG. 4 is a longitudinal sectional view of the door locking handle assembly in its locked position, taken along the line A—A of FIG. 1.
Figure 5:
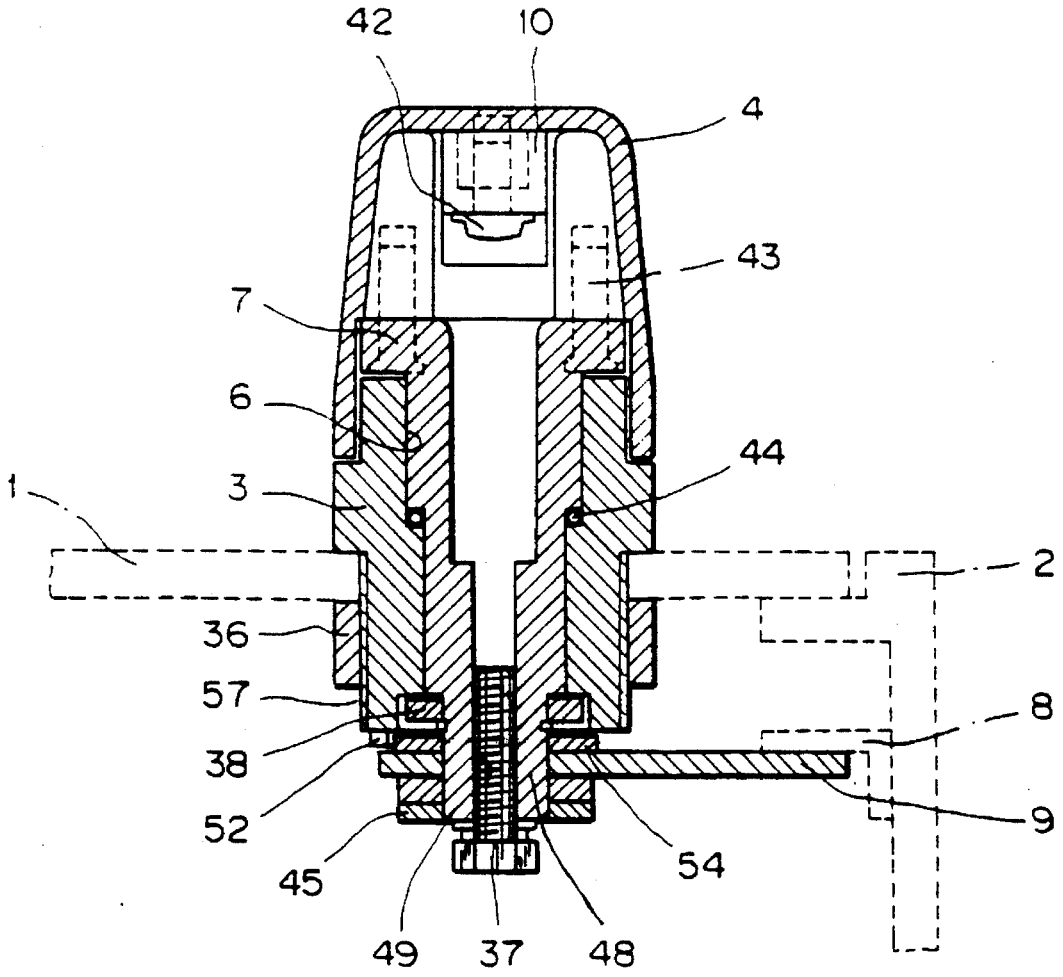
FIG. 5 is a cross-sectional view of the door locking handle assembly in its locked position, taken along the line B—B of FIG. 1.

Hereinbelow, the present invention will be described in detail with reference to the accompanying drawings and the reference numerals therein.

A door locking handle assembly of the present invention comprises: a cylindrical bearing portion 6 integrally formed with a base-end portion of a base member 3 which is fixedly mounted on a door 1; a shaft 7 which is fixedly mounted in a base-end portion of a handle piece 4 and rotatably mounted in the cylindrical bearing portion 6 in an insertion manner; a catch plate 9 fixedly mounted in a rear-end portion of the shaft 7, the catch plate 9 being engaged with and disengaged from a retaining member 8 of a stationary frame element 2; a holder 10 fixedly mounted on a bottom wall of the base-end portion of the handle piece 4; a first horizontal pin 11 inserted in an axial hole 12 of the holder 10; a lock lever 5 which is mounted in such a way as to pivot about on the first horizontal pin 11; a rotation-urging spring 35 mounted between a projection 33 of a bottom wall of the handle piece 4 and a projection 34 of a front-end portion of the lock lever 5; a latch casing 18 having its base-end portion fixedly mounted in a front-end portion of the handle piece 4, the base-end portion of the latch casing 18 being provided with an axial hole 19; and, a second horizontal pin 21 inserted in both the axial hole 19 and a rotation-restricting oval hole 20 formed in a front-end portion of the lock lever 5.

Further, the door locking handle assembly of the present invention comprises: a hollow socket or receiving portion 32 integrally formed with the front-end portion of the lock lever 5; a pair of stopper projections 14 and 15 which are integrally formed with a base-end portion of the lock lever 5 and the front-end portion of the lock lever 5, respectively; a pair of engaging grooves 16 and 17 for engaging with and disengaging from the stopper projections 14 and 15 respectively, the engaging grooves 16 and 17 being integrally formed with the base-end portion of the handle piece 4 and the front-end portion of the handle piece 4, respectively; a lock-receiving portion 22 integrally formed with the front-end portion of the handle piece 4; a lock unit 23 mounted and received in the lock-receiving portion 22; a joint member 25 interlocked with a rotor 24 of the lock unit 23; a receiving groove 28 engaging with an engaging projection 26 of the joint member 25; a latch element 27 which is interlocked with the joint member 25 to move back and forth and received in the latch casing 18; an engaging projection 30 formed in a rear-end portion of the latch element 27 so as to be engaged with and disengaged from a groove 29 formed in the base member 3; and, a dead bolt 46 formed in a base-end portion of the latch element 27 so as to be engaged with and disengaged from the receiving portion 32 of the lock lever 5.

In the door locking handle assembly of the present invention having the above construction: the dead bolt 46 of the latch element 27 is received in the receiving portion 32 of the lock lever 5 to hold the lock lever 5 in its locked position; and, the stopper projections 14 and 15 of the lock lever 5 engage with the engaging grooves 16 and 17 respectively to divide torque from the shaft 7 and receive the thus divided torque, so that the handle piece 4 is locked to the base member 3.

As shown in FIG. 1, in a condition in which the handle piece 4 is aligned with the base member 3, the catch plate 9 is in its locked position in which the catch plate 9 engages with the retaining member 8 to lock the door 1 to the stationary frame element 2. When a proper key 41 is inserted into the lock unit 23 and turned in a locking direction thereof, the latch element 27 is rotatably driven in its locking direction through the rotor 24 with which the latch element 27 is interlocked, so that the dead bolt 46 of the latch element 27 is engaged with the receiving portion 32 of the lock lever 5, whereby the door 1 is properly locked to the stationary frame element 2.

After the rotor 24 is rotated in its unlocking direction by the use of the key 41 to have the latch element 27 separated from the receiving portion 32 of the latch element 27, the user grasps the handle piece 4 so as to have the lock lever 5 retracted by a predetermined amount so that the stopper projections 14 and 15 of the lock lever 5 are disengaged from the engaging grooves 16 and 17, respectively. Thereafter, when the shaft 7 is rotated in its unlocking direction, the catch plate 9 is disengaged from the retaining member 8 to release the door 1 from the stationary frame element 2, which enables the user to open the door 1 by pulling the handle piece 4 forward.

In the embodiment of the present invention shown in the drawings, the shaft 7 and the handle piece 4 form separate members so that the shaft 7 is fixedly mounted on a rear surface of the handle piece 4 by means of flush bolts perpendicular to the rear surface of the handle piece 4. A water-tight O-ring 44 is mounted between an outer peripheral surface of an intermediate portion of the shaft 7 and an inner peripheral surface of the cylindrical bearing portion 6. The catch plate 9 is provided with a square through-hole 47 which is fitted to a rear-end portion 48 of the shaft 7. Also fitted to the rear-end portion 48 of the shaft 7 are a pair of square-shaped washers 45. Then, a hexagon headed bold 37 is threadably engaged with a threaded hole 49 of the rear-end portion 48 of the shaft 7, so that the catch plate 9 is fixedly mounted on the rear-end portion 48 of the shaft 7.

The holder 10 is fixedly mounted on the handle piece 4 through a cup-head screw 42 which is threadably engaged with a threaded hole 50 formed in a projection of a bottom wall of the handle piece 4. The first horizontal pin 11 is inserted in both the axial hole 12 of the holder 10 and the axial hole 13 of the lock lever 5, so that the lock lever 5 is pivoted to the handle piece 4 through the horizontal pin 11. A rotation-urging or bias spring 35 constructed of a compression coil spring is mounted between the projection 33 of the bottom wall of the handle piece 4 and the projection 34 of the front-end portion of the lock lever 5 to rotatably urge the lock lever 5 (which is retracted when the user grips the handle piece 4 so as to lock the assembly) to its locked position in which the stopper projections 14 and 15 are engaged with the engaging grooves 16 and 17, respectively.

A pair of arch-shaped projections 52 for restricting a turning angle of the handle piece 4 relative to the base member 3 are provided in a rear-end portion 51 of the base member 3 to extend in a circumferential direction of the rear-end portion portion 51. A stopper member 54 is provided with a pair of restricting projections 53. The member 54 is fixedly mounted on the rear-end portion 48 of the shaft 7 so as to have its projections 53 arranged substantially concentrically with the projections 52 of the base member 3. In operation, the restricting projections 53 of the stopper member 54 abut on a left and a right end portion of the arch-shaped projections 52 of the base member 3 to restrict the turning angle of the handle piece 4 relative to the base member 3 within an angle of 90 degrees in each of the clockwise and counterclockwise directions.

The base member 3 has its rear-end portion 51 mounted in a receiving bole of the door 1, and has its positioning projection 55 mounted in a positioning hole of the door 1. The positioning projection 55 of the base member 3 is provided in a rear surface of the front-end portion of the base member 3. An outer peripheral portion of the rear-end portion 51 of the base member 3 is formed into a threaded portion 57 which is threadably engaged with a hexagon nut 36, while the positioning projection 55 of the base member 3 is provided with a threaded hole 58 which is threadably engaged with a hexagon headed bolt 39 passing through a fastening plate 40, so that the base member 3 is fixedly mounted on the door 1 through the nut 36 and the bolt 39.

The latch casing 18 embedded in a hollow portion in the rear side of the lock-receiving portion 22 is fixedly mounted on the handle piece 4 through four flush bolts 43. A locking element 59 is constructed of the joint member 25 and the latch element 27. The locking element 59 is slidably mounted in an elongated hole 60 of the latch casing 18 which is arranged parallel to the base member 3.

As shown in FIG. 1, in a condition in which the handle piece 4 is aligned with the base member 3: the catch plate 9 is in its locked position in which the catch plate 9 engages with the retaining member 8; and, the door I is locked to the stationary frame element 2 when the key 41 is inserted into the lock unit 23 and turns the rotor 24 in its unlocking direction, the joint member 25 interlocked with the rotor 24 is driven in its unlocking direction, so that the latch element 27 follows the joint member to have the dead bolt 46 thereof engaged with the receiving portion 32 of the lock lever 5.

In operation, the rotor 24 is rotated in its unlocked direction by the key 41, so that the dead bolt 46 of the latch element 27 is disengaged from the receiving portion of the lock lever 5. The lever 5 is then retracted to a predetermined position when the handle piece 4 is gripped by the user so as to have the stopper projections 14 and 15 disengaged from the engaging grooves 16 and 17, respectively. After that, when the shaft 7 is rotated in its unlocked direction, the catch plate 9 is released from the retaining member 8.

In the door locking handle assembly of the present invention having the above construction, since the stopper projections 14, 15 are provided in opposite ends of the lock lever 5 and engaged with the engaging grooves 16, 17 so as to disperse the torque from the shaft, it is possible to improve the assembly of the present invention in structural strength, which eliminates the fear of deformation and breakage of the lock unit 23 of the assembly.

Further, in the door locking handle assembly of the present invention, since the dead bolt 46 of the locking element 59 can not be received in the receiving portion 32 of the lock lever 5 in any other positions except the locked position of the lock lever 5, it is not possible for the user to operate the lock unit 23 when the catch plate 9 fixed to the shaft 7 is in its locked position. Consequently, there is no fear of overlooking the unlocked condition of the catch plate 9 in the assembly, and, therefore a fear of leaving the lock unit 23 unlocked is eliminated.

I claim:

1. A door locking handle assembly, comprising:

a cylindrical bearing portion (6) integrally formed with a base-end portion of a base member (3) for fixedly mounting on a door (1);

a shaft (7) which is fixedly mounted in a base-end portion of a handle piece (4) and rotatably mounted in said cylindrical bearing portion (6) in an insertion manner;

a catch plate (9) fixedly mounted in a rear-end portion of said shaft (7), said catch plate (9) being engageable with and disengageable from a retaining member (8) of a stationary frame element (2);

a holder (10) fixedly mounted on a bottom wall of said base-end portion of said handle piece (4);

a first horizontal pin (11) inserted in an axial hole (12) of said holder (10);

a lock lever (5) which is mounted in such a way as to pivot about on said horizontal pin (11);

a rotation-urging spring (35) mounted between a projection (33) of a bottom wall of said handle piece (4) and a projection (34) of a front-end portion of said lock lever (5);

a latch casing (18) having its base-end portion fixedly mounted in a front-end portion of said handle piece (4), said base-end portion of said latch casing (18) being provided with an axial hole (19);

a second horizontal pin (21) inserted in both said axial hole (19) and a rotation-restricting oval hole (20) formed in a front-end portion of said lock lever (5);

a hollow socket portion (32) integrally formed with said front-end portion of said lock lever (5);

a pair of stopper projections (14) and (15) which are integrally formed with a base-end portion of said lock lever (5) and said front-end portion of said lock lever (5), respectively;

a pair of engaging grooves (16) and (17) for engaging with and disengaging from said stopper projections (14) and (15) respectively, said engaging grooves (16) and (17) being integrally formed with said base-end portion of said handle piece (4) and said front-end portion of said handle piece (4), respectively;

a lock-receiving portion (22) integrally formed with said front-end portion of said handle piece (4);

a lock unit (23) mounted and received in said lock-receiving portion (22);

a joint member (25) interlocked with a rotor (24) of said lock unit (23);

a receiving groove (28) engaging with an engaging projection (26) of said joint member (25);

a latch element (27) which is interlocked with said joint member (25) to move back and forth and received in said latch casing (18);

an engaging projection (30) formed in a rear-end portion of said latch element (27) so as to be engaged with and disengaged from a groove (29) formed in said base member (3); and a dead bolt (46) formed in a base-end portion of said latch element (27) so as to be engaged with and disengaged from said receiving portion (32) of said lock lever (5);

wherein: said dead bolt (46) of said latch element (27) is received in said receiving portion (32) of said lock lever (5) to hold said lock lever (5) in its locked position; and, said stopper projections (14) and (15) of said lock lever (5) engage with said engaging grooves (16) and (17) respectively to divide torque from said shaft (7) and receive the thus divided torque so that said handle piece (4) is locked to said base member (3).

2. The door locking handle assembly according to claim 1, wherein said handle piece (4) includes a pair of projections (52) and said shaft (7) includes a part of projections (53) which restrict the turning angle of the handle piece to 90 degrees.

3. The door locking handle assembly according to claim 1, wherein said base member (3) is mounted onto a door (1) by having a rear-end portion (51) and a positioning projection (55) of said base member inserted through a receiving hole in the door.

* * * * *